US009453517B1

(12) United States Patent
Burns et al.

(10) Patent No.: US 9,453,517 B1
(45) Date of Patent: Sep. 27, 2016

(54) REMOTE RETAINER BRACKET FOR HUGGER FAN

(71) Applicant: Palm Coast Imports, LLC, Germantown, TN (US)

(72) Inventors: James Burns, Memphis, TN (US); Brendan Byrne, Germantown, TN (US)

(73) Assignee: HKC-US, LLC, Memphis, TN (US)

( * ) Notice: Subject to any disclaimer, the term of this patent is extended or adjusted under 35 U.S.C. 154(b) by 345 days.

(21) Appl. No.: 14/186,693

(22) Filed: Feb. 21, 2014

(51) Int. Cl.
*F04D 29/60* (2006.01)
*F04D 25/08* (2006.01)

(52) U.S. Cl.
CPC ..... *F04D 29/601* (2013.01); *F04D 25/088* (2013.01)

(58) Field of Classification Search
CPC .... F04D 25/08; F04D 25/088; F04D 29/601; F04D 29/646
USPC ..... 417/423.14, 424.15
See application file for complete search history.

(56) References Cited

U.S. PATENT DOCUMENTS

| | | | | |
|---|---|---|---|---|
| 4,465,956 | A | 8/1984 | Fowler | |
| 4,548,554 | A | 10/1985 | Angott | |
| 5,147,234 | A * | 9/1992 | Brug | B63B 35/7936 280/14.24 |
| 5,242,269 | A | 9/1993 | Chang | |
| 5,340,277 | A | 8/1994 | Whitaker | |
| 5,613,832 | A | 3/1997 | Su | |
| 6,015,274 | A * | 1/2000 | Bias | F04D 25/088 417/423.1 |
| 6,200,099 | B1 | 3/2001 | Liao | |
| 2005/0006549 | A1 * | 1/2005 | Liu | F04D 29/601 248/343 |

OTHER PUBLICATIONS

Harbor Breeze Merrimack 52-in White Outdoor Flush Mount Ceiling Fan with Light Kit and Remote Control, 2015, http://www.lowes.com/pd_593744-1811-RLC52WW5C1R_0_?productId=50179275&Ntt=, 2 pages.
Harbor Breeze, Merrimack Ceiling Fan, Model #RLC52WW5C1R, Item #0593744, Manual, Date???, 36 pages.

* cited by examiner

*Primary Examiner* — Devon Kramer
*Assistant Examiner* — Christopher Brunjes
(74) *Attorney, Agent, or Firm* — Brian S. Steinberger; Law Offices of Brian S. Steinberger, P.A.

(57) ABSTRACT

Devices, apparatus, brackets, systems and methods for mounting a remote control receiver off-axis and to the side of motor mount bracket inside a ceiling mounted hugger and low profile fan housing.

18 Claims, 14 Drawing Sheets

REMOTE RETAINER BRACKET FOR HUGGER FAN

FIELD OF INVENTION

This invention relates to remote controls, and in particular to devices, apparatus, brackets and methods for mounting a remote control receiver off-axis and below the motor mount bracket inside a ceiling mounted hugger fan housing.

BACKGROUND AND PRIOR ART

Remote controls are often used in ceiling fans hanging from down rods with canopies attached to ceilings, wherein a handheld remote control activates a remote receiver in side of the fan which turns the fan on and off. The open cavity of the canopy can have enough room for the receiver to be inside. See for example, U.S. Pat. No. 5,430,277 to Whitaker and U.S. Pat. No. 5,613,832 to Su.

However, hugger type low-profile fans have motor housings generally attached directly to a ceiling without a down rod, and have little room to mount a remote receiver inside the housing. In view of the limited space it is difficult to install remote control receivers inside of the hugger type low-profile fan housings. Additionally, there is a danger of the remote receiver and/or the loose wires attached to the receivers can fall into the moving motor which can damage the motor and be dangerous to those underneath the ceiling mounted fan.

Additionally, if the wires and remote receivers are not firmly secured, the receiver and wires can rattle causing undesirable noise and vibration.

FIG. 1A is a top perspective view of a prior art hugger ceiling fan 10 with motor inside the shroud housing 15 and prior art elongated hanger bracket 20 and motor 25 hanging inside of the housing. FIG. 1 B is a side interior view of the prior art housing 15 of FIG. 1A showing the bracket along the top of the upper open end of the housing 15.

Attempts have been made over the years to try and mount remote receivers in the housings, but are difficult to use. For example, U.S. Pat. No. 6,015,274 to Bias et al. describes a low profile ceiling fan having a remote control receiver. However, the remote receivers are generally required to have apertures (holes) through upper and/or lower portions of the receiver housings in order to be mounted. Forming holes into an existing receiver would not be desirable since it can damage the receiver.

Another embodiment in this reference shows the remote receiver mounted on top of the motor mount bracket which would not be desirable since the motor bracket is intended to be substantially flush mounted. As such, there is little or no room on the top of the bracket.

Another embodiment shows the remote receiver directly mounted underneath the bracket. Similarly, this would also not be desirable since it would be difficult to attach when the top of the receiver is not accessible.

Another embodiment generally requires the receiver to be slid into a pocket type opening under the end of the bracket, which may be difficult to insert into. Also, the pocket may not be a secure fit and could result in the remote receiver moving about causing undesirable noise and vibration.

Thus, the need exists for solutions to the above problems in the prior art.

SUMMARY OF THE INVENTION

A primary objective of the invention is to provide devices, apparatus, brackets, systems and methods for mounting a remote receiver off-axis and to the side of a motor mount bracket inside a ceiling mounted hugger fan housing.

A secondary objective of the invention is to provide devices, apparatus, brackets, systems and methods for mounting a remote receiver inside a ceiling mounted hugger fan housing without forming apertures in the remote receiver.

A third objective of the invention is to provide devices, apparatus, brackets, systems and methods for mounting a remote receiver inside a ceiling mounted hugger fan housing without mounting the receiver on top of a motor mount bracket.

A fourth objective of the invention is to provide devices, apparatus, brackets, systems and methods for mounting a remote receiver inside a ceiling mounted hugger fan housing without mounting the receiver to the bottom of a motor mount bracket.

A fifth objective of the invention is to provide devices, apparatus, brackets, systems and methods for mounting after market remote receivers inside existing ceiling mounted hugger fan housings.

A sixth objective of the invention is to provide devices, apparatus, brackets, systems and methods for mounting a remote control receiver inside a ceiling mounted hugger fan housing on a ledge off a motor mounting bracket, wherein the ledge has openings for allowing heat ventilation therethrough.

A seventh objective of the invention is to provide devices, apparatus, brackets, systems and methods for mounting a remote receiver inside a ceiling mounted hugger fan housing on a ledge off a motor mounting bracket, and openings for safely passing wires, eliminating the wires falling into the motor.

A mounting system for mounting remote control receivers in low profile ceiling fan housings, comprising a ceiling fan housing having an upper open end and a lower open end having a diameter smaller than the diameter of the upper open end, an elongated generally rectangular mounting bracket having a left side and a right side, and a first end and a second end, the first end attached to a first upper rim portion of the upper open end of the housing, and the second end attached to a second upper rim portion of the upper open end of the housing opposite to the first upper rim portion of the housing, a motor mounted to a mid portion of the elongated bracket between the first end and the second end hanging underneath the mounting bracket; a side shelf extending sideways from one of the left side or the right side of the elongated bracket; and a remote control receiver mounted on the side shelf.

The side shelf can have an L shape with a vertical leg attached to one of the left side and the right side of the elongated bracket, with a horizontal leg spaced below and extending sideways from the elongated bracket.

The system can include a strap having one end hingedly attached to one of the sides of the elongated bracket, and having an opposite end that attaches to the shelf, the strap for mounting the remote receiver to the shelf. The strap can be a metal strap. The strap can be a zip tie.

The shelf can have side holes for allowing wires to safely pass therethrough. The shelf can include holes in the support surface for heat ventilation adjacent to the remote receiver.

The shelf can be attached to one side of the elongated bracket by weld. The shelf can be attached to one side of the elongated bracket by a fastener. The elongated bracket and the shelf can be formed from one piece.

An embodiment of a ceiling fan, can include a ceiling fan housing having an upper open end and a lower open end having a diameter smaller than the diameter of the upper open end, an elongated generally rectangular mounting bracket having a left side and a right side, and a first end and a second end, the first end attached to a first upper rim portion of the upper open end of the housing, and the second end attached to a second upper rim portion of the upper open end of the housing opposite to the first upper rim portion of the housing, a motor mounted to a mid portion of the elongated bracket between the first end and the second end hanging underneath the mounting bracket substantially inside of the housing, a side shelf extending sideways from one of the left side or the right side of the elongated bracket, a remote control receiver mounted on the side shelf, and a plurality of ceiling fan blades mounted to a lower portion of the motor below the lower open end of the housing.

The side shelf can have an L shape with a vertical leg attached to one of the left side and the right side of the elongated bracket, with a horizontal leg spaced below and extending sideways from the elongated bracket.

The fan can include a strap having one end hingedly attached to one of the sides of the elongated bracket, and having an opposite end that attaches to the shelf, the strap for mounting the remote receiver to the shelf. The strap can be a metal strap. The strap can be a zip tie.

The shelf can include side holes for allowing wires to safely pass therethrough. The shelf can include holes in the support surface for heat ventilation adjacent to the remote receiver.

The shelf can be attached to one side of the elongated bracket by weld. The shelf can be attached to one side of the elongated bracket by a fastener.

The elongated bracket and the shelf can be formed from one piece.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1A:
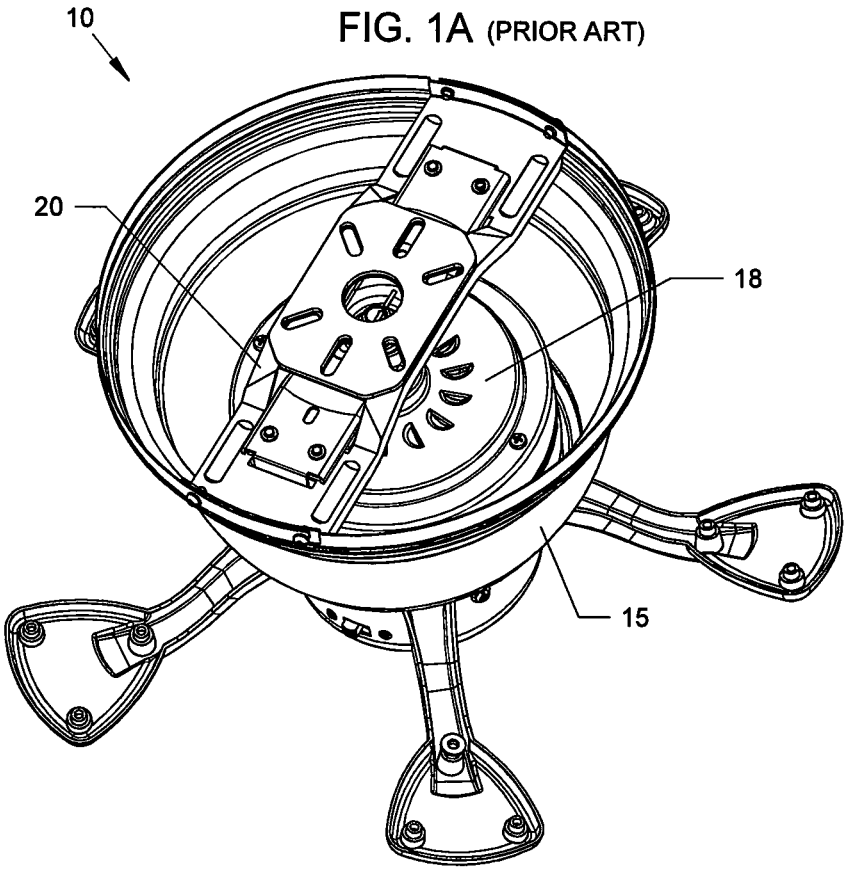
FIG. 1A (PRIOR ART)
FIG. 1A is a top perspective view of a prior art hugger ceiling fan motor housing with prior art hanger bracket.
Figure 1B:
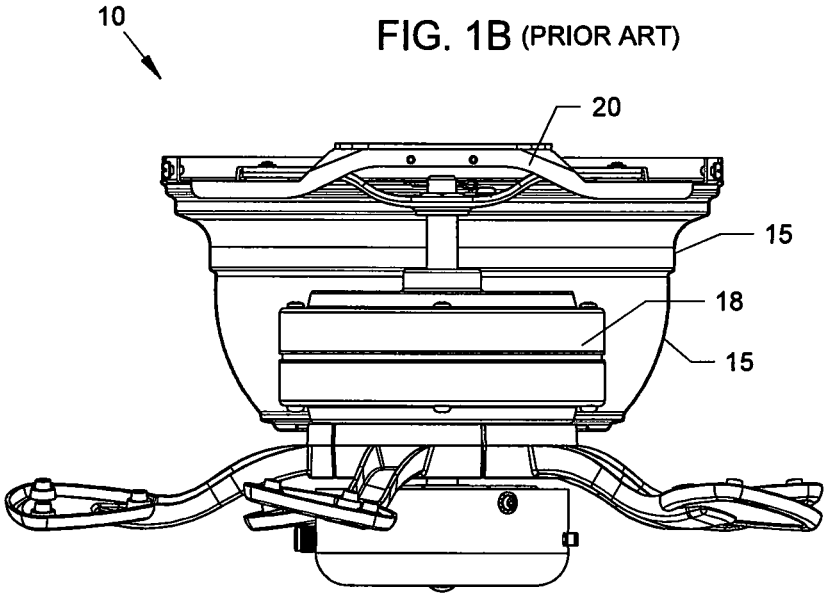
FIG. 1B (PRIOR ART)
FIG. 1 B is a side interior view of the prior art housing of FIG. 1A.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

10 Ceiling fan (prior art).
15 Fan motor shroud housing (prior art).
18. Motor
20 Hanger bracket/elongated generally rectangular mounting bracket (prior art)
23 side holes in the hanger bracket
25 Ceiling fan with remote ready shelf installed.
30 Remote ready shelf
31 flat side edges
32 Vertical leg
33 holes in vertical leg
34 inwardly angled sides
35 flat side edge
36 horizontal leg
38 convex curved edge

Figure 2:
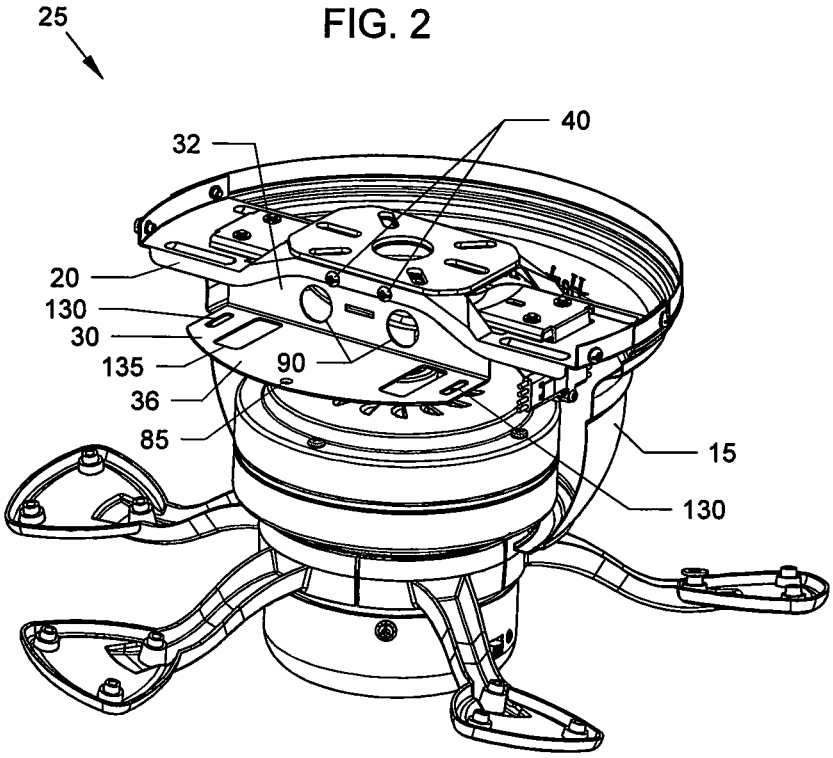
FIG. 2 is a top perspective partial cut-away view inside of a hugger ceiling fan motor housing with hanger bracket and novel remote ready shelf attached.
Figure 3:
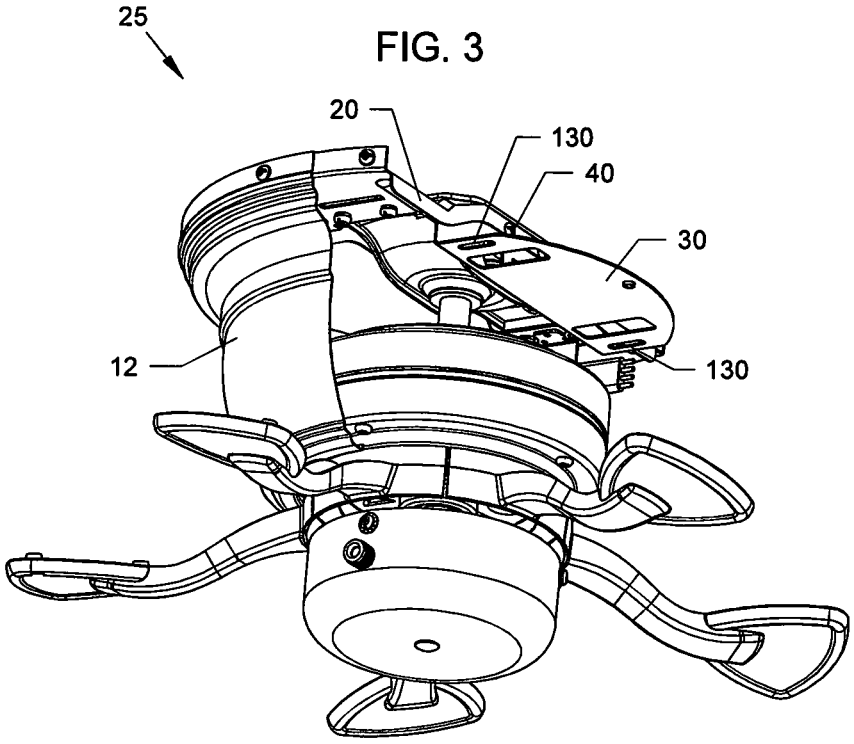
FIG. 3 is a bottom perspective view of the hugger ceiling fan motor housing with hanger bracket and novel remote read shelf attached of FIG. 2.
Figure 4:
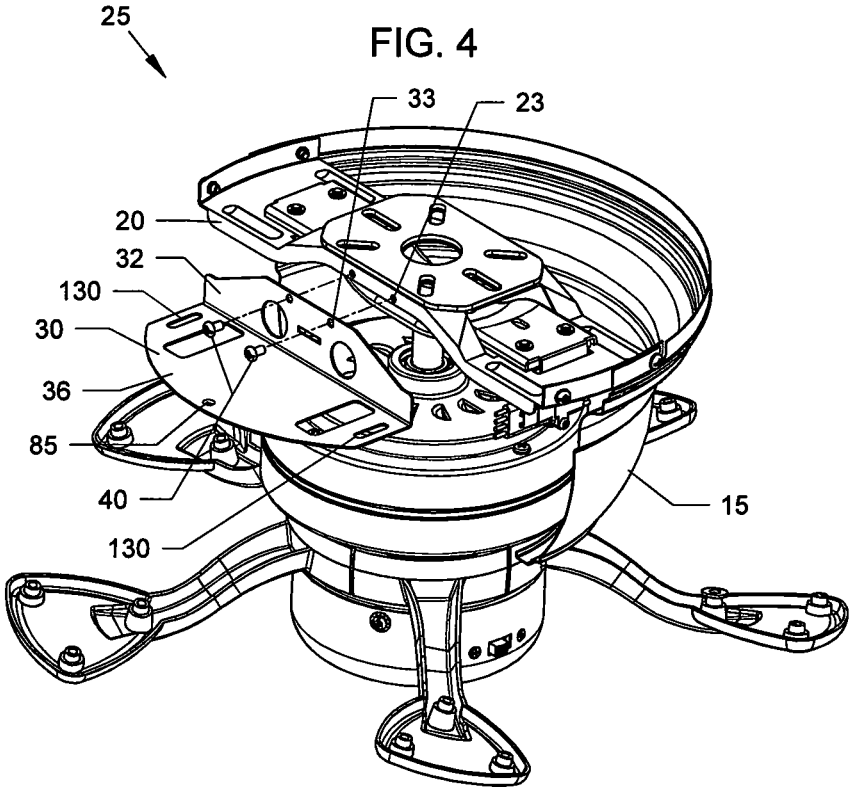
FIG. 4 is another top perspective partial cut-away view of the hugger ceiling fan motor housing of FIG. 2 showing exploded view of the novel shelf installation.

40 Shelf mounting screws.
50 Tie down brace/strap.
52 inner bent end
56 outer bent end
57 fastening hole
60 Tie down brace mounting screw.
70 Tie down brace retaining tab.
80 Slot in remote ready shelf retains tab of tie down brace.
85 fastening hole
90 Wire egress hole in remote ready shelf.
100 Ceiling fan remote receiver.
110 Plastic zip tie used as alternative to tie down brace to secure remote receiver to shelf.
120 Control wires from receiver to and from motor 18
130 Slots in shelf for zip tie installation
135 large slots in shelf for heat ventilation FIG. 2 is a top perspective partial cut-away view 25 inside of a hugger ceiling fan motor housing 15 with the hanger bracket 20 and novel remote ready shelf 30 attached. FIG. 3 is a bottom perspective view 25 of the hugger ceiling fan motor housing 15 of FIG. 2 with hanger bracket 20 and novel remote read shelf 30 attached. FIG. 4 is another top perspective partial cut-away view 25 of the hugger ceiling fan motor housing 15 of FIG. 2 showing exploded view of shelf 130 installation.

Referring to FIGS. 1-4, the novel shelf 130 can have an L shape with a vertical leg 32 having holes 33 therethrough, and a horizontal leg 36. Fasteners 40, such as but not limited to screws, and bolts can attach vertical leg 32 through holes 33 into threaded openings in side holes 23 in the hanger bracket 20.

Figure 5:
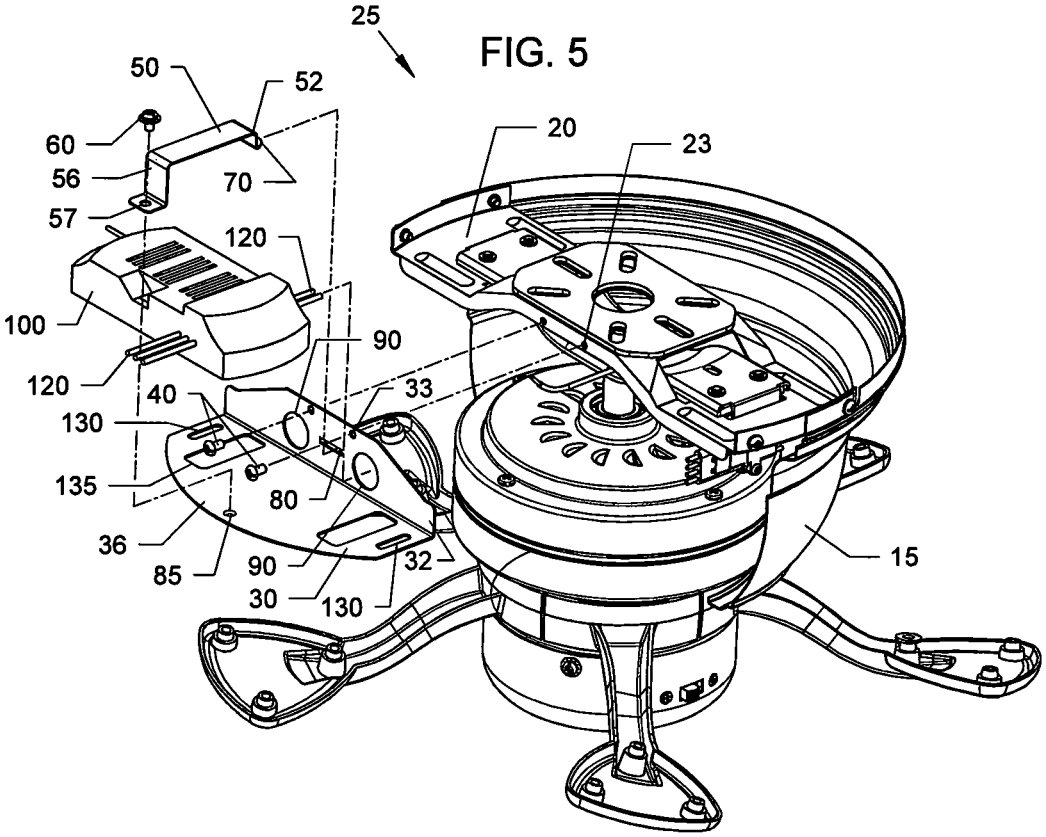
FIG. 5 is another top perspective view of the ceiling fan motor housing of FIG. 4 with exploded view of the shelf and remote control receiver before installation.
Figure 6:
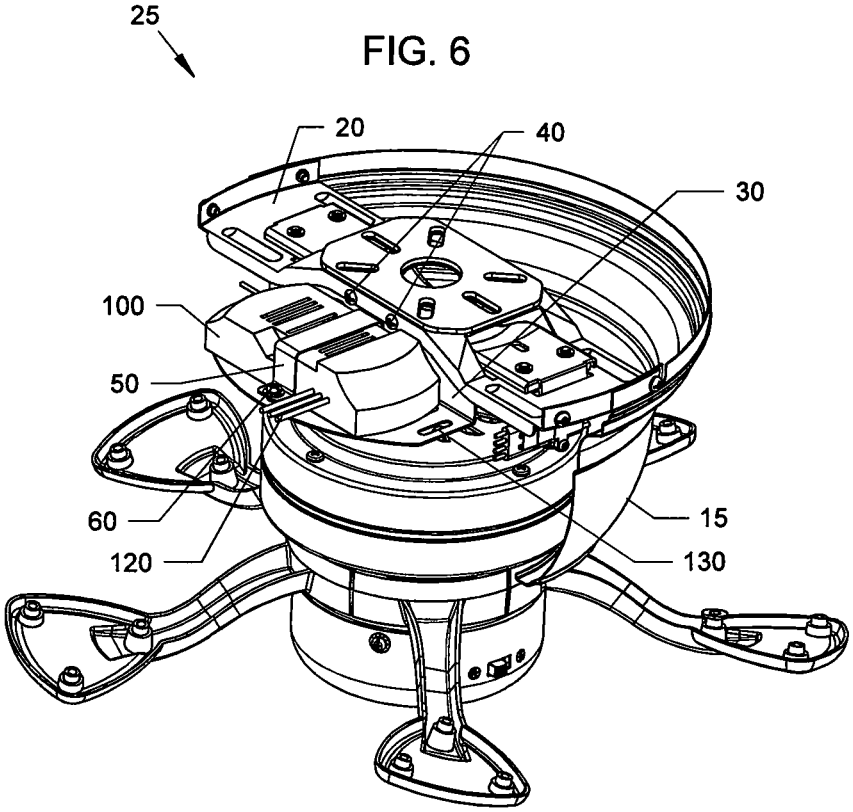
FIG. 6 is a top perspective view of the fan motor housing of FIG. 5 with shelf attached to hanger bracket and remote receiver installed with tie down brace.
Figure 7:
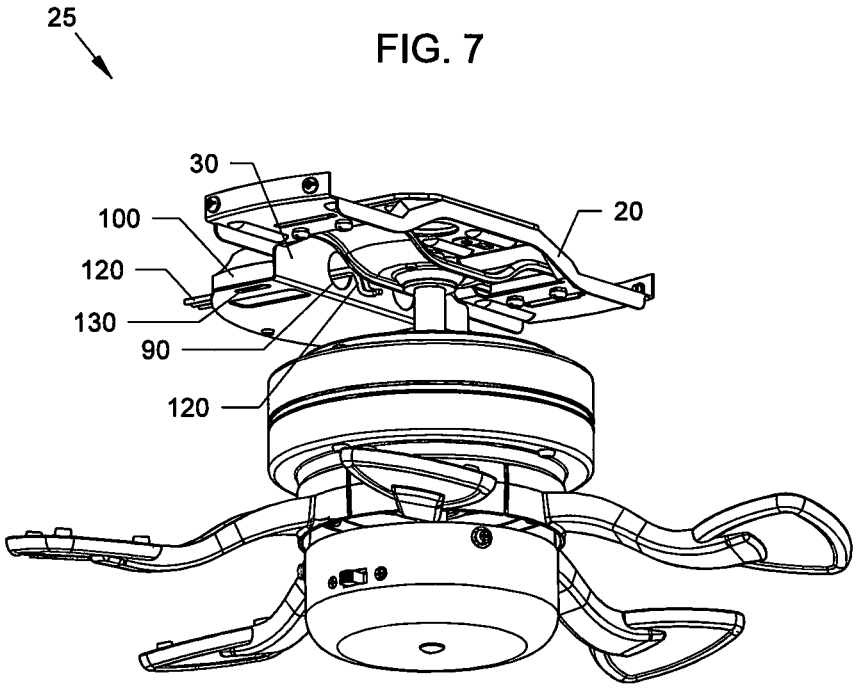
FIG. 7 is a bottom perspective view of FIG. 6 showing the receiver control wires routing through the wire egress hole in the shelf.

FIG. 5 is another top perspective view of the ceiling fan motor housing 15 of FIG. 4 with exploded view of the shelf 39 and remote control receiver 100 before installation. FIG. 6 is a top perspective view of the fan motor housing 15 of FIG. 5 with shelf 30 attached to hanger bracket 20 and remote receiver 100 installed with tie down brace 50. FIG. 7 is a bottom perspective view of FIG. 6 showing the receiver control wires 120 routing through the wire egress hole 90 in the shelf 30.

Referring to FIGS. 4-7, the outwardly angled tie down brace retaining tab 70 off of the inner bent portion 52 of the tie down brace 50 can be inserted into a slot 80 in the vertical leg 32 of the shelf 30, with the opposite free end in a raised position. Next the generally flat bottom of the remote control receiver 100 can be placed on the upper surface horizontal leg 36 of the shelf 30 abutting the vertical leg 32. Next the opposite bent free end 56 of the brace 50 can be rotated downward where the tab 70 hinges inside slot 80. The installer can attach a fastener 60, such as a screw or bolt into hole 57 of tie down brace 50 and into threaded opening 85 in horizontal leg 36 of the shelf 30 which secures the receiver 100 to the shelf 30.

Wiring 120 on the side of the receiver 100 can be oriented to pass directly through wire egress hole(s) 90 helping secure the wires 120 so that they do not flap or are in danger of falling into motor 18 below. If the receiver 100 is mounted with wires on opposite side, the wires 120 can be easily wrapped over and/or under the receiver 100 and horizontal leg 36 and still be manipulated to pass into egress holes 90. Large holes 135 and/or slots 130 in horizontal leg 36 can be useful for allowing heat ventilation from the receiver 100 to pass there through so as to reduce and eliminate heating up of the receiver 100

Figure 8:
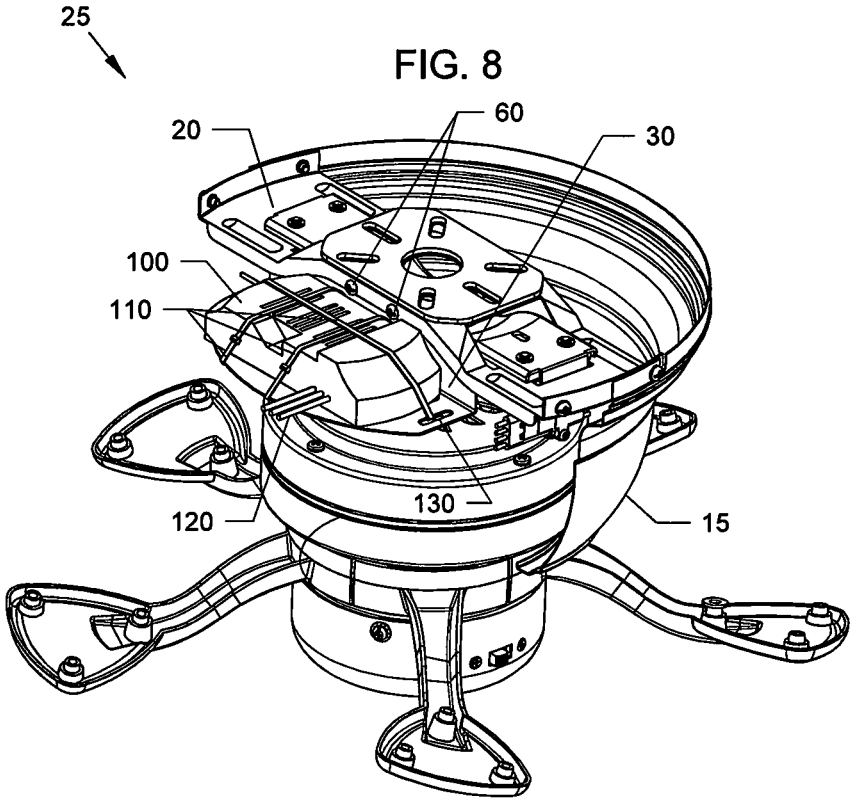
FIG. 8 is a top perspective view of the receiver secured to the shelf with plastic zip lock ties instead of the tie down brace.
Figure 9:
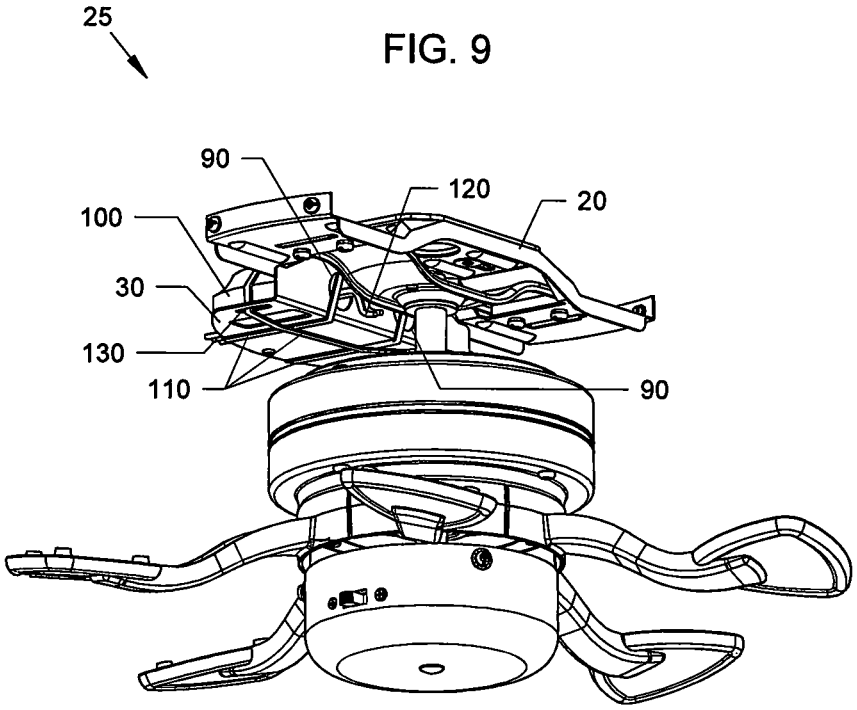
FIG. 9 is a bottom perspective view of FIG. 8 showing zip lock ties routing through the wire egress holes in the shelf to facilitate securing the receiver to the shelf.

FIG. 8 is a top perspective view of the receiver 100 secured to the shelf 30 with plastic zip lock ties 110 running through slots 130 instead of the tie down brace 50. FIG. 9 is a bottom perspective view of FIG. 8 showing zip lock ties 110 routing through the wire egress holes 90 in the shelf to facilitate securing the receiver to the shelf. The invention can use as few as one zip tie 110 running across a mid portion of the receiver 100, or two ties in parallel, or three ties 110 at least two of which cross over one another.

Figure 10:
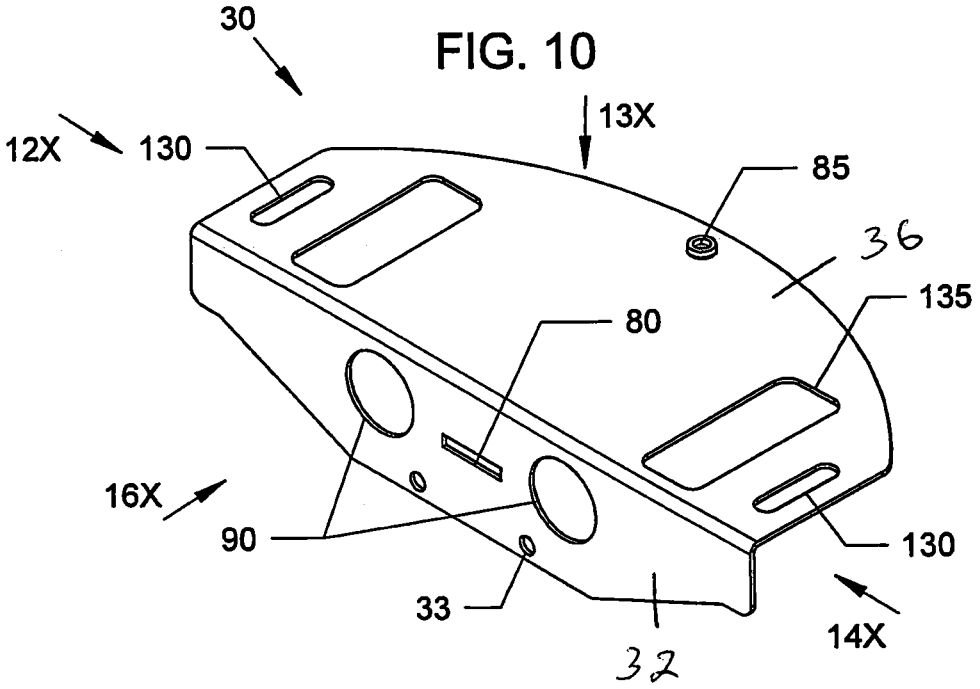
FIG. 10 is a bottom perspective view of the remote ready shelf of FIGS. 2-8.
Figure 11:
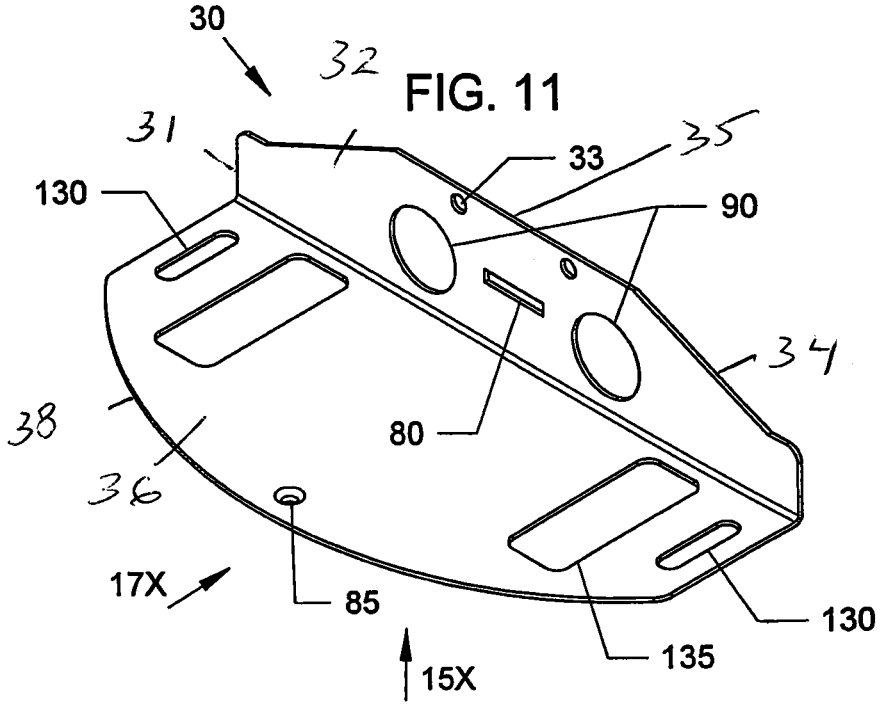
FIG. 11 is a top perspective view of the shelf of FIG. 10.
Figure 12:
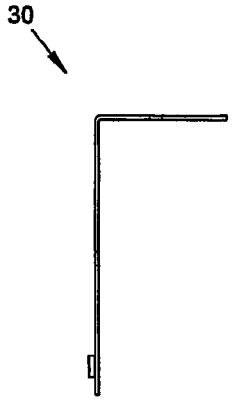
FIG. 12 is a left side view of the shelf of FIG. 10 along arrow 12X
Figure 13:
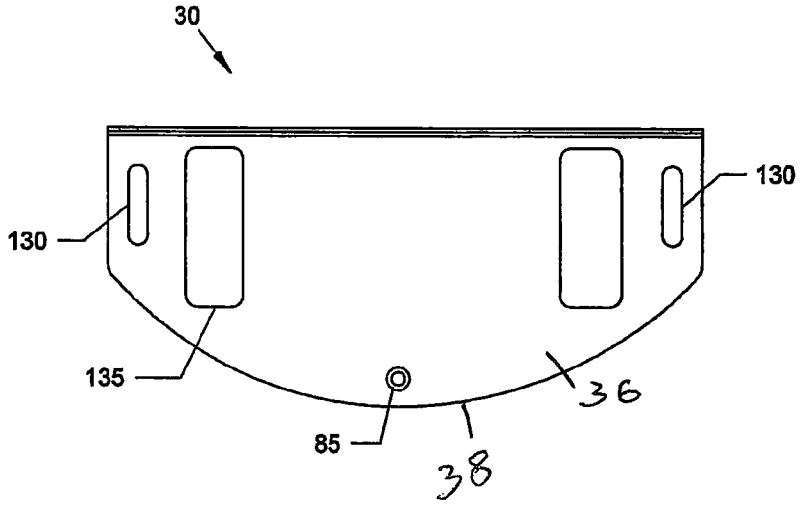
FIG. 13 is a top view of the shelf of FIG. 10 along arrow 13X.
Figure 14:
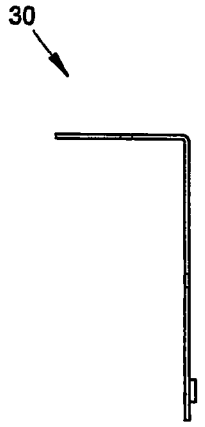
FIG. 14 is a right side view of the shelf of FIG. 10 along arrow 14X.
Figure 15:
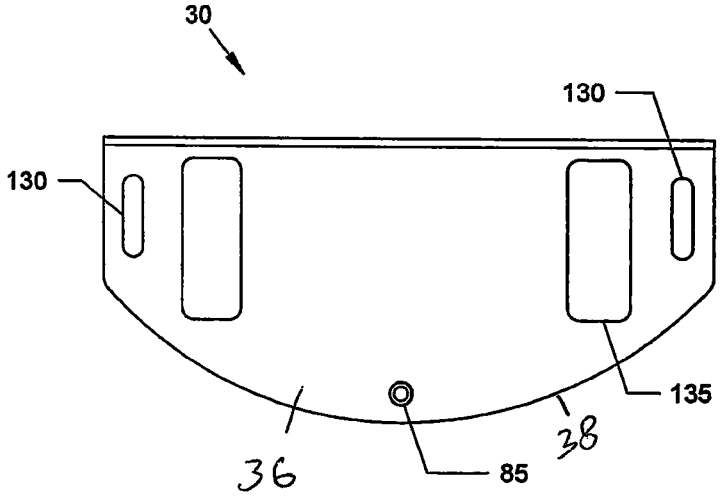
FIG. 15 is a bottom view of the shelf of FIG. 11 along arrow 15X.
Figure 16:
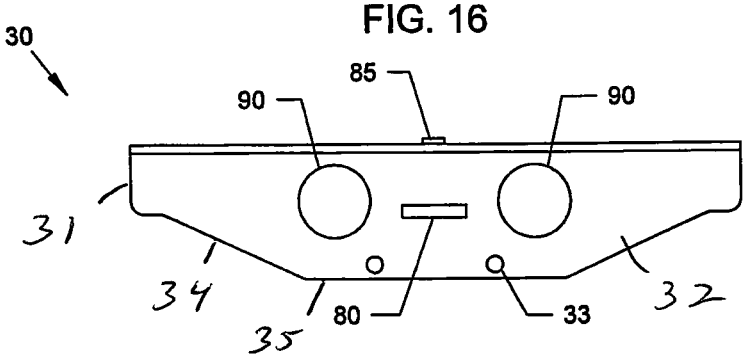
FIG. 16 is a rear view of the shelf of FIG. 10 along arrow 16X.
Figure 17:
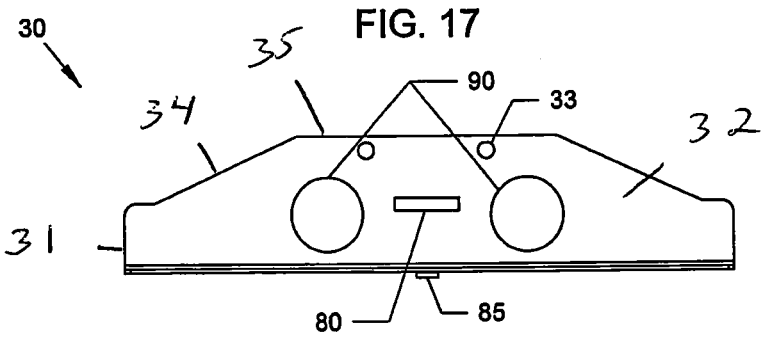
FIG. 17 is a front view of the shelf of FIG. 11 along arrow 17X.

FIG. 10 is a bottom perspective view of the remote ready shelf 30 of FIGS. 2-8. FIG. 11 is a top perspective view of the shelf 30 of FIG. 10. FIG. 12 is a left side view of the shelf 30 of FIG. 10 along arrow 12X FIG. 13 is a top view of the shelf 30 of FIG. 10 along arrow 13X. FIG. 14 is a right side view of the shelf 30 of FIG. 10 along arrow 14X. FIG. 15 is a bottom view of the shelf 30 of FIG. 11 along arrow 15X. FIG. 16 is a rear view of the shelf 30 of FIG. 10 along arrow 16X. FIG. 17 is a front view of the shelf 30 of FIG. 11 along arrow 17X.

The shelf can have a generally L shaped configuration with a vertical leg 32 attached to a left side or a right side of the bracket 20 so that the horizontal leg 36 extends sideways from the main longitudinal axis of the bracket 20. The horizontal leg 36 is preferably below the bracket 20 so that the top of the mounted receiver is either flush with or below the top surface of the bracket 20. The shelf 30 is preferably being positioned into dead space to one side of the bracket. The novel shelf allows for using the existing dead space inside of a fan housing, and does not raise the top of the remote receiver to be above the existing bracket inside of the housing. The location of the shelf makes it easy for attaching the remote receiver to the shelf.

The vertical leg 32 can include a generally flat plate surface with flat side edges 31 and inwardly angled side edges 34 which meet with an outwardly extending flat side edge 35.

The horizontal leg 36 can include a generally flat rectangular plate surface with an outwardly extending convex curved edge 38. The horizontal leg 36 can have a larger plate surface than the vertical leg 32.

The bracket 20 and shelf 30 can be formed from metal, such as but limited to galvanized metal, aluminum, and the like.

While the shelf and the bracket are shown as two parts which can use fasteners, such as but not limited to screws and bolts for attaching each part to one another, the shelf and bracket can be formed from one piece of material.

The invention can use an existing remote receiver that exists in the marketplace, where the remote receiver does not need to be modified by putting holes or separate cases about the receiver.

The invention can be manufactured with the remote receiver already installed on the shelf before the ceiling fan is shipped from the manufacturer.

Alternatively, the remote receiver can be installed separately by the ceiling fan installer as an after-market installation, where the remote receiver and the transmitter can be sold in a package to be installed by the end user installer. In this version, the shelf can be pre-installed during manufacture.

Also, the remote receiver and the transmitter and the shelf can be sold separately in a package for installation by the ceiling fan installer.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A mounting system for mounting remote control receivers in low profile ceiling fan housings, comprising:

a ceiling fan housing having an upper open end and a lower open end having a diameter smaller than the diameter of the upper open end;

an elongated mounting bracket which is generally rectangular in shape, having a left side and a right side, and a first end and a second end and a raised midportion, the first end attached to a first upper rim portion of the upper open end of the housing, and the second end attached to a second upper rim portion of the upper open end of the housing opposite to the first upper rim portion of the housing;

a motor mounted to the raised midportion of the elongated mounting bracket between the first end and the second end hanging underneath the mounting bracket;

straps;

a side shelf extending sideways from one of the left side or the right side of the midportion of the elongated mounting bracket, the shelf consisting of an L shape having a single vertical leg and a single horizontal leg, the shelf having holes for heat ventilation and for the straps, the single horizontal leg being spaced below the raised midportion of the elongated mounting bracket; and a remote control receiver without holes through which the straps pass through, the receiver being mounted to the side shelf by the straps.

2. The mounting system of claim 1, wherein the strap includes one end hingedly attached to one of the sides of the elongated mounting bracket, and having an opposite end that attaches to the shelf, the strap for mounting the remote receiver to the shelf.

3. The mounting system of claim 1, wherein the strap is a metal strap.

4. The mounting system of claim 1, wherein the strap includes a zip tie.

5. The mounting system of claim 1, wherein the shelf is attached to one side of the elongated mounting bracket by weld.

6. The mounting system of claim 1, wherein the shelf is attached to one side of the elongated mounting bracket by a fastener.

7. The mounting system of claim 1, wherein the elongated mounting bracket and the shelf are formed from one piece.

8. The mounting system of claim 1, wherein the horizontal leg includes a generally flat rectangular plate surface with an outwardly extending convex curved edge, and the vertical leg includes a generally flat plate surface with an outwardly extending flat side edge, the plate surface of the horizontal leg being larger in area than the plate surface than the vertical leg.

9. The mounting system of claim 8, wherein the vertical leg further includes flat side edges and inwardly angled side edges which meet with the outwardly extending flat side edge.

10. A ceiling fan, comprising:

a ceiling fan housing having an upper open end and a lower open end having a diameter smaller than the diameter of the upper open end;

an elongated mounting bracket which is generally rectangular in shape, having a left side and a right side, and a first end and a second end and a raised midportion therebetween, the first end attached to a first upper rim portion of the upper open end of the housing, and the second end attached to a second upper rim portion of the upper open end of the housing opposite to the first upper rim portion of the housing;

a motor mounted to the raised midportion of the elongated mounting bracket between the first end and the second end hanging underneath the elongated mounting bracket substantially inside of the housing;

straps;

a side shelf extending sideways from one of the left side or the right side of the midportion of the elongated mounting bracket, the shelf consisting of an L shape having a single vertical leg and a single horizontal leg, the shelf having holes for heat ventilation and the straps, the single horizontal leg being spaced below the raised midportion of the elongated mounting bracket;

a remote control receiver without holes through which the straps pass through, the receiver, being mounted on the single horizontal leg on the side shelf by the straps; and a plurality of ceiling fan blades mounted to a lower portion of the motor below the lower open end of the housing.

11. The ceiling fan of claim 10, wherein the straps include one end hingedly attached to one of the single vertical leg or the single horizontal leg of the elongated bracket, and having an opposite end that attaches to the shelf, the strap for mounting the remote receiver to the shelf.

12. The ceiling fan of claim 10, wherein the strap is a metal strap.

13. The ceiling fan of claim 10, wherein the strap includes a zip tie.

14. The ceiling fan of claim 10, wherein the shelf is attached to one side of the elongated mounting bracket by weld.

15. The ceiling fan of claim 10, wherein the shelf is attached to one side of the elongated mounting bracket by a fastener.

16. The ceiling fan of claim 10, wherein the elongated mounting bracket and the shelf are formed from one piece.

17. The ceiling fan of claim 10, wherein the horizontal leg includes a generally flat rectangular plate surface with an outwardly extending convex curved edge, and the vertical leg includes a generally flat plate surface with an outwardly extending flat side edge, the plate surface of the horizontal leg being larger in area than the plate surface than the vertical leg.

18. The mounting system of claim 17, wherein the vertical leg further includes flat side edges and inwardly angled side edges which meet with the outwardly extending flat side edge.

* * * * *